United States Patent [19]

Kercher

[11] Patent Number: 4,624,481

[45] Date of Patent: Nov. 25, 1986

[54] COMBINATION MULTIPLE PLY MANIFOLD BUSINESS FORM AND AIRLINE TICKET JACKET

[75] Inventor: David M. Kercher, Littleton, Colo.

[73] Assignee: Janet C. Kercher, Littleton, Colo. ; a part interest

[21] Appl. No.: 704,872

[22] Filed: Feb. 25, 1985

[51] Int. Cl.[4] ..... B41L 1/20; B65D 27/00; B65D 27/04

[52] U.S. Cl. ..... 282/11.5 A; 282/11.5 R; 229/74; 40/359

[58] Field of Search ..... 282/11.5 A, 11.5 R, 282/9 A, 9 R; 281/10, 14, 26; 229/74, 70; 40/359

[56] References Cited

U.S. PATENT DOCUMENTS 3,223,437 12/1965 Bertsch ..... 282/11.5 A
3,419,286 12/1968 Noonan et al. ..... 282/11.5 A
3,554,438 1/1971 Van Malderghem ..... 282/11.5 A
3,734,396 5/1973 Cowan ..... 229/74
4,301,962 11/1981 Monckton et al. ..... 40/359
4,493,496 1/1985 Kaluza ..... 282/11.5 A

*Primary Examiner*—Paul A. Bell
*Assistant Examiner*—Paul M. Heyrana, Sr.
*Attorney, Agent, or Firm*—Edwin L. Spangler, Jr.

[57] ABSTRACT

This invention relates to a multiple ply assembly form that is especially adapted for use with a computer printer and which enables the user to simultaneously generate an original and at least two copies of an invoice and the customer's itinerary with the latter appearing on the upturned face of the bottom ply which folds to produce a ticket jacket having both a ticket pocket on the inside and a boarding pass-receiving slit on the outside.

15 Claims, 10 Drawing Figures

COMBINATION MULTIPLE PLY MANIFOLD BUSINESS FORM AND AIRLINE TICKET JACKET

The travel industry is rapidly becoming automated and by far the majority of those involved in booking reservations for airlines, trains, car rentals, hotel and motel accommodations and making other arrangements for the traveler do so using some type of computerized reservation system. Once these arrangements have been made and confirmed, they are outputed to a computer printer which prints them out along with the related costs to the purchaser on a manifold business form. Such forms are commonly referred to in the travel industry as "invoice/itinerary" or "i/i" forms and they customarily consist of an original and an appropriate number of copies necessary to accommodate the needs of the customer along with those of the travel agency issuing same. The original is customarily used for invoicing while the remaining plies can be used as statement copies, agency accounting copies and an itinerary copy for the traveler.

This itinerary copy becomes very useful to the customer since it provides a summary of such information as arrival times, inflight meal services, car rental information, hotel arrangements, tours, etc. that are generally not shown on the tickets themselves which usually only set forth the carrier, the time and date of departure and the flight number. A complete and properly prepared itinerary may even include such useful information as the phone numbers to call to confirm reservations, affiliated agencies at the various destinations that are available in case assistance is needed, arrangements that have been made to handle children, elderly travelers or those who are ill, and the like. The main point is that to whatever extent the i/i provides the traveler with more information than he or she has on the ticket, it becomes a worthwhile addendum.

Customarily, the airline ticket jacket functions as the repository for the tickets, the boarding passes, the baggage checks, the i/i and whatever else in the way of documentation the traveler requires en route. Since each carrier is conscious of the advertising value of the ticket jacket which, more often than not, is carried in the hand or sticking out of a pocket, each time a transfer is made from one carrier to another, a new jacket is used. While a good deal of care is ordinarily exercised by the airline personnel to insure that everything gets back into the jacket, there is always the possibility that the i/i and other loose items can become lost or misplaced. Even more likely is the fact that the i/i becomes "dog-eared" and shopworn through repeated staplings and rough handling. Moreover, the i/i is, in most instances printed on a lightweight ply of the multiple ply form which makes it a good deal more vulnerable to abuse and repeated handling.

One solution that has been tried while preserving the inherent advantages of the multiple ply manifold business form used in computer printers is to print the itinerary on the last or bottom ply and make the latter of heavier stock than those above which must be thinner if the printer is to print through the several plies legibly. Unfortunately, this approach does not work well since the tickets and other travel documents must be stapled to this sheet and no pocket is available to provide them proper protection.

Another approach that has been tried is to transfer the itinerary information generated for the i/i from into a conventional ticket jacket. While the travel documents are far less likely to become lost than by merely being stapled to the face of the itinerary form, the operation is both time-consuming and expensive since redoing the itinerary a second time is very labor-intensive and also ties up the printing facilities or requires that they be duplicated.

Yet another effort to solve the problem took the form of increasing the width of the last two plies of the more or less standard width i/i form so that these wider sheets could be combined to form the desired ticket pocket. The difficulties encountered with this approach proved to be even more onerous than the previously-mentioned ones. Significant among these were the inability of the printer in some instances to handle plies in a multiple ply form of varying widths without occasionally jamming. The forms also did not stack properly and were very prone to slipping and falling over requiring the insertion of shims during shipping and processing of the forms through the printer. Some printers proved to be incapable of handling these forms because of its width and the printer head in others if not accurately adjusted had a tendency to catch on the short sheets. In other instances, not all the computer-generated information appeared on the final assembly of the ticket jacket. Notwithstanding the fact that the final product was usually satisfactory and acceptable to the customer, the travel agency personnel whose duties included making up the packet found them to be most unhandy, difficult to prepare and most inefficient due to a significantly increased number of manual operations required to make them up.

An unsatisfied need remains, therefore, in the travel industry for a multiple ply manifold form adapted for use in a standard computer-operated printer that will print the customer's itinerary on a sheet of heavier stock than that contained in the other plies thereabove while being formable simply, easily and quickly into a ticket jacket having an inside ticket pocket for tickets, baggage checks and other travel documents along with an exterior slit for boarding passes.

It has now been found in accordance with the teaching of the present invention that, in fact, a combination multiple ply manifold assembly form and airline ticket jacket can be made which is fully compatible with existing computer-operated printers. By locating the lowermost two plies that cooperate to define the ticket pocket at the top of the form, these plies together with those overlying the latter can be run up through the printer to a point where they become accessible without having to raise the noise shield of the printer. All printing on the assembled form is confined to the area below the pocket-producing plies so that having the upper end thereof thus accessible is in no way limiting as far as the utilitarian aspects of the form are concerned. In the preferred embodiment of the invention, the plies overlying the pocket-forming plies are connected together to form a separate multiple ply form detachably connected to the main form which can be used for any one of a number of applications not necessarily even related to the travel business.

The section of the form overlying the lowermost ply in the stack thereof and extending along the lower edge of the above-mentioned detachable multiple ply form comprise the multiple ply invoice/itinerary form upon which is typed the usual billing and pertinent travel information. This same information ends up printed upon the upturned face of the lowermost ply that is of heavier stock than the rest and which will ultimately end up as the outside of the ticket jacket. With the i/i printed inside the jacket and off to one side of the travel document pocket therein, it is readily accessible to the traveler at all times and is not in a position to be obscured by anything in the pocket. Moreover, when thus situated on the inside of the heaviest ply, the i/i is less susceptible to being smeared, defaced or otherwise damaged.

The combination form and ticket jacket is ideally suited for use by travel agencies and the like who wish to take advantage of the advertising value of a custom-designed jacket that stays with the traveler for his or her entire journey for the simple reason that the i/i forms an integral and inseparable part thereof that is not likely to be thrown away by airline personnel who wish to substitute their own emblazoned with the logo, name and message of the carrier. In addition, the whole area on the underside of the lowermost ply which forms the outside of the ticket jacket and includes even the top section, i.e. the area behind the travel document pocket, is available and appropriately used to display the traveler's name, provide a handy expense recording area and summarize the flight information details such as date, carrier, flight number, time of departure and arrival. Depending on the length of the form, provision is easily made for car rental and hotel reservations, prearranged baggage-handling and limousine service, travel club membership information and application forms, etc.

Since each ply of the form is full width and full length when assembled, they stack easily and no difficulty is experienced running them through the printer. Separating the individual forms from the manifold is greatly facilitated by having the upper edge thereof readily accessible from underneath the noise shield of the printer without having to lift it up each time. Once removed from the printer, the side edges containing the line holes that are engaged to step the continuous form through the printer are easily removed and discarded preparatory to separating the multiple ply i/i form from the auxiliary multiple ply form thereabove. What is left is the ticket jacket precut to produce both the ticket pocket and boarding pass slit. With the i/i already a part of the jacket, one need only fill in the information on the back or outside thereof, place the ticket in the pocket, fold the pocket inside the jacket and hand it to the customer.

It is, therefore, the principal object of the present invention to provide a novel and improved combination multiple ply manifold form and ticket jacket ideally suited for use with computer operated printers.

A second objective is the provision of a form of the type aforementioned which has the traveler's invoice and itinerary printed inside the ticket jacket alongside the pocket for the tickets and other travel documents.

Another object of the invention herein disclosed and claimed is that of providing multiple ply form with the pocket-forming section of the jacket being so located and arranged along the top edge such that it, together with the plies overlying the latter, need not be printed upon but remain accessible from underneath the noise shield of the printer and materially facilitate removal of the completed assembly.

Still another objective of the within-described invention is the provision of a ticket jacket wherein the traveler's itinerary remains at all times an integral part thereof located in a protected position inside where it is less likely to become damaged or defaced while, at the same time, being imprinted upon heavier-than-usual stock better able to withstand repeated use and abuse.

An additional object is to provide a multiple-use combination ticket jacket and i/i form that is precut to accept boarding passes.

Further objects are to provide a combination i/i form and travel document jacket that is simple, easy to manipulate, efficient, usable with existing computer-operated printers, versatile, capable of being used in fanfolded form without having to separate each form once it is completed, equally well suited for ground travel on trains and the like as in aircraft, relatively inexpensive and even somewhat decorative.

Other objects will be in part apparent and in part pointed out specifically hereinafter in connection with the description of the drawings that follows, and in which.

Figure 1:
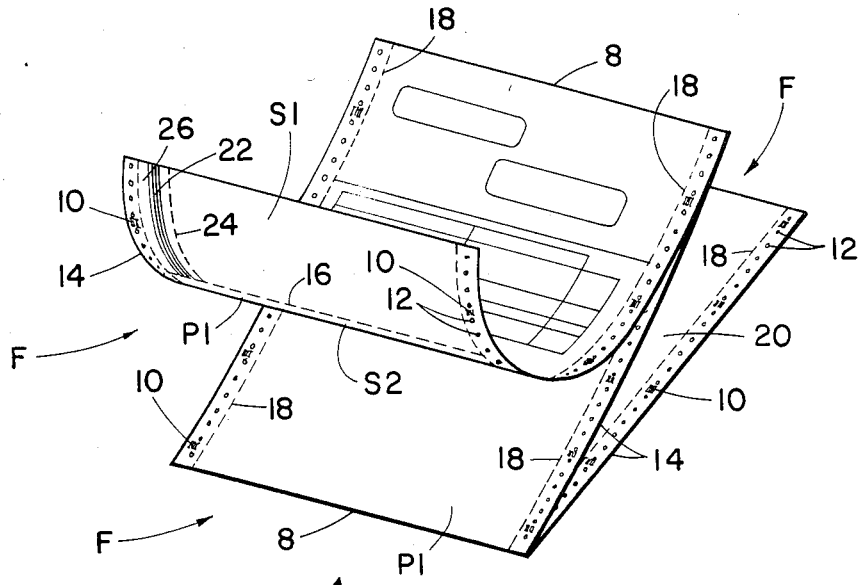
FIG. 1 is a perspective view showing three of the forms connected together in conventional manifold relation.
Figure 2:
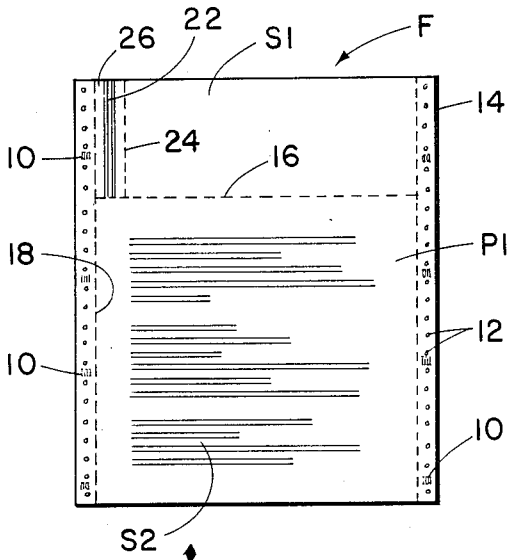
FIG. 2 is a top plan view of one of the completed forms prior to disassembly.
Figure 3:
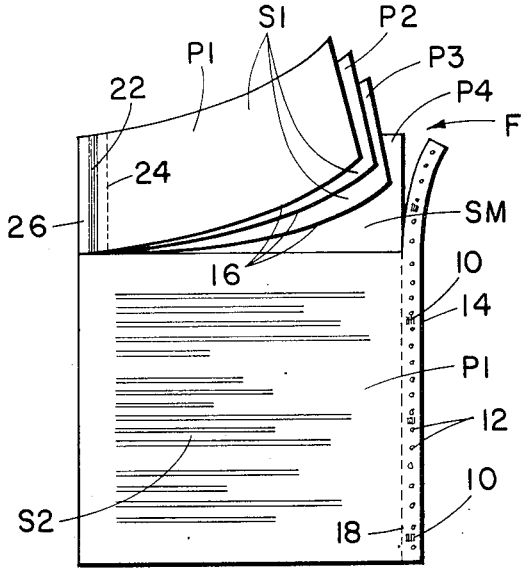
FIG. 3 is a top plan view showing one of the side margins containing the sprocket holes already removed from the form while the other side margin is in the process of being removed along with the detachable multiple ply section running across the top thereof.
Figure 4:
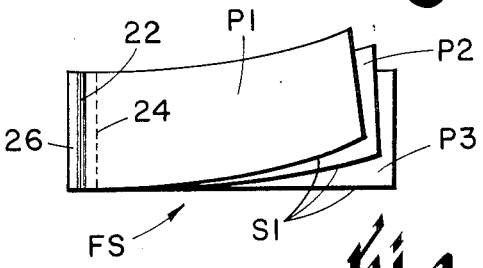
FIG. 4 is a top plan view of the detached section.

Referring next to the drawings for a detailed description of the present invention and, initially, to FIGS. 1, 2 and 3 for this purpose, reference letter F has been chosen to broadly designate the multiple ply form in its entirety while P1, P2, P3, P4 and P5 refer, respectively, to its several plies or webs going from the uppermost to the lowermost. Since plies P4 and P5 are needed to form the ticket jacket indicated in a general way in FIGS. 5–10, inclusive, to which detailed reference will be made presently, and since the issuing entity needs two copies of the invoice/itinerary (i/i) in addition to the copy provided the traveler printed on ply 5 as part of the ticket jacket, at least two additional plies P3 and P4 are generally required as a minimum. The five ply configuration shown is preferred, however, over a lesser number.

Individual multiple ply forms F can, of course, be used but they are preferably fanfolded in the well known manner as shown in FIG. 1. Horizontally disposed serrations 8 enable the individual assemblies F to be separated from one another. Fanfolding increases efficiency and has other advantages which are not pertinent here. It should probably be pointed out, however, that the forms need not necessarily be separated from one another as soon as they are printed, but may advantageously be left in fanfolded form and detached at infrequent intervals, perhaps only once a day.

Each ply or web in the assembly form F is of equal width. All but the lowermost ply P5 are preferably made of paper of approximately equal weight, usually the carbonless self-encapsulated variety although, of course, bond paper interleaved with carbon tissue can also be used. The lowermost ply P5, on the other hand, is usually of heavier weight carbonless or bond paper since, as will be explained presently, it forms the ticket jacket J. If the forms are to be typewritten, the plies need only be temporarily and detachably joined together as by means of the crimped areas 10 that appear in the particular embodiment illustrated between each series of sprocket holes or so-called "line holes" 12 in the detachable edge strips 14. These line holes 12, of course, adapt the form F for use with a computer-driven printer in which a sprocket gear of some description steps the form through the printer. Be that as it may, the crimped areas along the side margins of the form function to temporarily hold the plies together and in proper registry while being printed or typed regardless of whether they are contained in removable edge strips 14 or, alternatively, are placed along one or both side margins of plies having no such strips.

In FIGS. 1–4, it can be seen that a second serrated edge 16 extends horizontally across each of the assembly forms intermediate the top and bottom edges thereof. This last-mentioned serration does not, however, extend through all five plies but instead only the uppermost three, namely, P1, P2 and P3. The vertical serrations 18, on the other hand, that separate the detachable edge strips 14 from the rest of the form do, in fact, go through all five of the plies and thus permit the removal of these edge strips once the form has been printed and is ready for disassembly. FIG. 3, for example, shows the edge strip on the lefthand side removed altogether while the other one on the righthand side is in the process of being taken off.

Now, horizontal serration 16 spaced down approximately three inches from the top edge of the form creating section S1 has several functions. To begin with, since the sections of plies P4 and P5 that lie beneath section S1 will eventually become the pocketed inside of the ticket jacket J, it is best that section S1 not be imprinted at the time the i/i is being made up. In other words, while the upturned section SM of ply P4 could, if desired, be preprinted in the manner of the downturned face 20 of ply P5 (see FIGS. 1 and 7) that forms the outside of the ticket jacket J, it is best left free of computer printing or typing added at the time the form is being used. This being the case, sections S1 at the top of plies P1, P2 and P3 are best left blank as shown while a part of the full length assembly; however, provision is advantageously made for keeping these three partial plies together as a subassembly in the manner best seen in FIGS. 3 and 4 to which detailed reference will next be made.

Section S1 of plies P1, P2 and P3 are preferably fastened together by vertically-extending glue lines 22 between plies P1 and P2 and between plies P2 and P3 lying just to the right of the lefthand edge strip 14 and immediately to the left of still another vertical serration 24 that parallels serration 18 but only extends from top to bottom of sections S1. With the edge strips 14 removed as shown in FIG. 3, the subassembly form that has been indicated in a general way in FIG. 4 using the letter designators FS can be detached from the remainder of form F by separating it along horizontal serration 16. Subassembly form FS thus becomes a separate triple ply entity that has many uses such as, for example, as a travel insurance application form, travel club membership application form, etc. Alternatively, section S1 of ply P1 can be preprinted to set forth terms and conditions, liability disclaimers and other information while the remaining two plies underneath can be separated from the top one and used as a two ply form. Subassembly FS, of course, has a detachable edge strip 26 which, upon removal at serration 24, allows the plies to be separated one from another.

Now, by confining the printing added by the computer printer below serration 16M in FIGS. 5 and 6, section SM of the fourth ply P4 is left blank as previously noted; however, in addition, sections S1, SM and the corresponding section lying at the top of ply P5 become "leaders" that extend well above the platen of the printer and emerge from beneath its noise shield for ready access by the operator when the time comes to remove same. At this point, of course, the complete assembly form F is intact in that neither of the edge strips 14 have been removed and subassembly form FS remains as an integral part of the whole.

Figure 5:
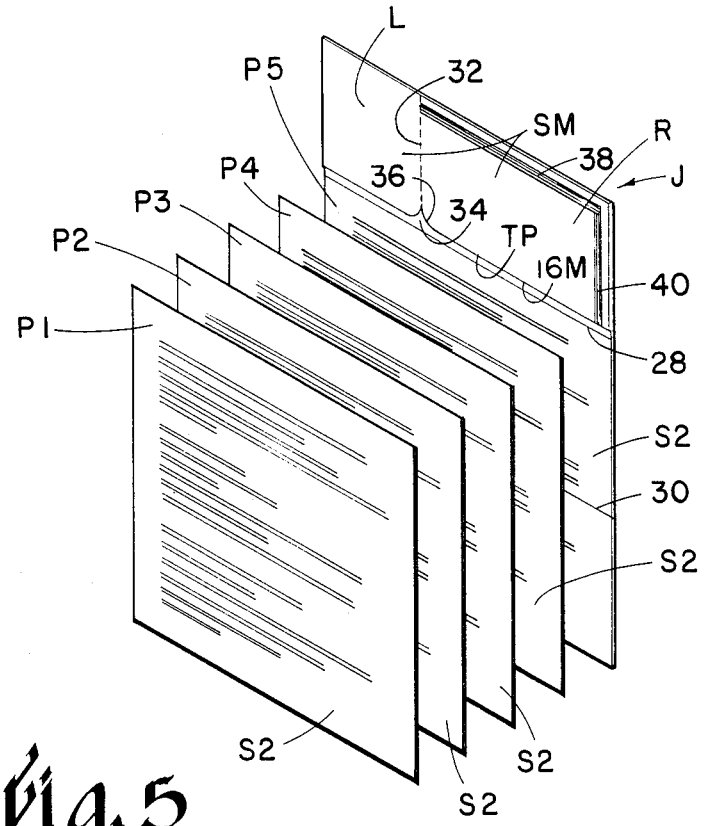
FIG. 5 is an exploded perspective view showing the plies that are imprinted with the invoice/itinerary including the lowermost pair that cooperate to define the ticket jacket, travel document pocket and boarding pass slit therein.
Figure 6:
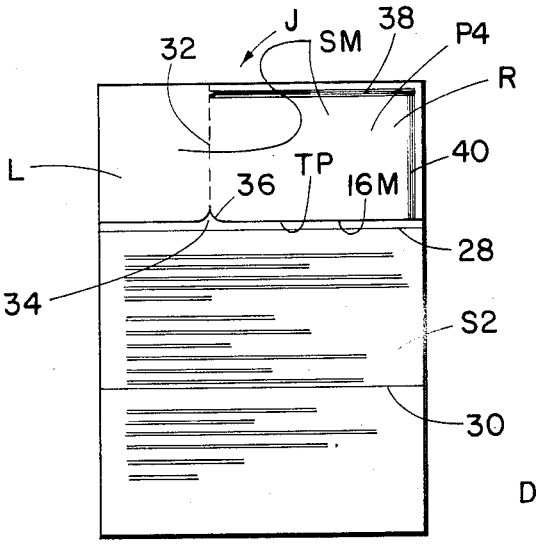
FIG. 6 is a top plan view of the inside of the ticket jacket.

Referring particularly to FIGS. 2, 3 and 5 sections S2 that lie below the horizontal serrations 16 of plies P1, P2 and P3, below the horizontal serration 16M of ply P4 and below the corresponding section of SM at the top of ply P5, are designed to be imprinted at the time of use and plies P1, P2, P3 and P4 thus become, upon being separated as shown in FIG. 5, several copies of the "i/i" form. In many instances, ply P1 will be used as the original billing copy, ply P2 a statement copy and ply P3 as an accounting copy. The i/i will be imprinted on the upturned faces S2 of all five plies including P5 which is the ticket jacket J. In the latter instance, as will be seen presently, the i/i information will appear alongside the ticket pocket TP (see FIGS. 5, 6 and 8). Section S2 of ply P4 will, of course, be imprinted and thus constitute an additional copy of the i/i which can be given to the traveler, used by the agency or sometimes sent to the home office of a multi-agency operation.

Now, before proceeding with a detailed description of the ticket jacket J, it should, perhaps, be pointed out that assembly form F can be easily adapted to the needs of an individual user by lengthening same to extend section S2 and/or adding other sections, thus providing for the printing of additional information, etc. As illustrated in FIGS. 5–10, the jacket includes two horizontal fold lines 28 and 30 that divide it in thirds. A fourth section could easily be included separated from the other three by a horizontal fold line. The form illustrated is a simple one and it includes all the elements necessary to define the ticket jacket J and appurtenances thereto.

Beginning with FIG. 5, it will be seen that section SM of ply P4 is divided vertically by a vertically-extending serration 32 lying approximately one-third of the way from its lefthand edge. Also, at the juncture between the latter serration 32 and full length horizontal serration 16M between sections S2 and SM, a die-cut corner 34 of generally triangular shape is cut out as shown. Once section S2 of ply P4 has been detached along serration 16M, this frees lefthand subsection L for detachment from the righthand subsection R of section SM by tearing it away along serration 32. This leaves the righthand section R with a rounded lower lefthand corner 36 as seen in FIGS. 5 and 6. At this point the righthand subsection R of section SM would also be detached from the equivalent section R of ply P5 therebehind if it were not for the fact that these two sections are glued together along the top and righthand edges by glue lines 38 and 40. Thus, subsection R of section SM of ply P4 cooperates with an equivalent section R of ply P5 to define the ticket pocket TP which, as seen in FIGS. 5 and 6 when subsection L is detached is open along the left side and along the bottom. With fold line 28 lying spaced beneath serration 16M, ample space is provided for the reception of a ticket T (FIG. 8) while still allowing the jacket J to be folded. Rounded corner 36 facilitates opening of the pocket and prevents it from becoming "dog-eared".

Figure 7:
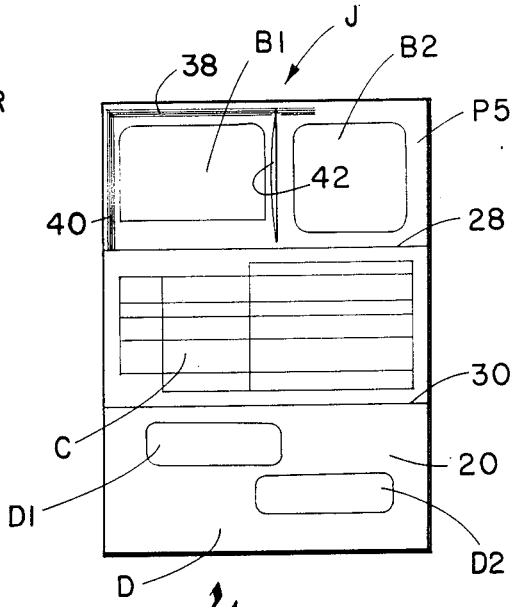
FIG. 7 is a top plan view of the outside of the ticket jacket.
Figure 8:
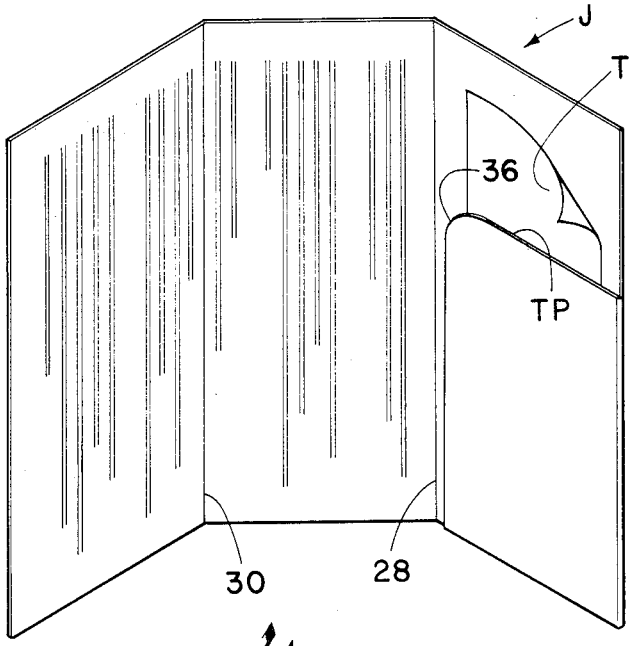
FIG. 8 is a perspective view of the inside of the ticket jacket showing a travel document in place therein.
Figure 9:
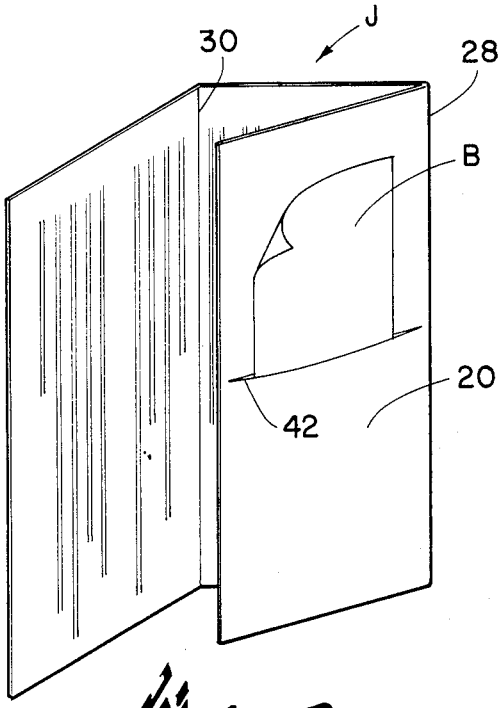
FIG. 9 is a perspective view similar to FIG. 8 except that the flap containing the boarding pass slit has been folded in to expose same along with a boarding pass therein; and, FIG. 10 is a perspective view similar to FIGS. 8 and 9 showing the ticket jacket in a folded condition such that the traveler's name and that of the person who prepared it are displayed on the outside.

Moving on to FIG. 7, the back or underside of ply P5 will be seen to be pre-imprinted with various information of assistance to the traveler. By way of example, as seen in FIG. 7, block B1 in the upper lefthand corner might contain places to write or type in various elements of flight information like, for instance, the carrier, flight number, gate and seat assignment. Block B2 could easily be pre-imprinted with an advertising message emanating from the issuing travel agency. Both sections B1 and B2 are, more than likely, folded onto the outside of the jacket J as shown in FIG. 9 where the boarding pass B is readily available sticking out of the pre-cut slit 42 provided therefor in the equivalent section R of ply P5 behind the ticket pocket TP.

Center section C on the backside of ply P5 as shown in FIG. 7, can be preprinted with, for example, a simplified expense account form covering a one week period or thereabouts to be filled in by the traveler during his or her journey. Even if this area is not used as a permanent record of traveling expenses, it can serve as a handy note pad upon which to jot down cab fares, tips and other miscellany en route.

Figure 10:
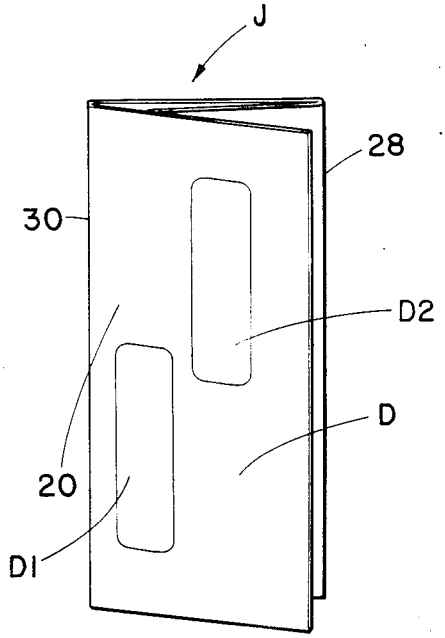

The bottom section D on the backside of ply P5 is shown in FIGS. 7 and 10 as having a pair of areas D1 and D2 one of which might be filled in with the name, address and phone number of the traveler while the other displays the name of the agency representative who prepared the travel documents. The jacket J, thus personalized, would ordinarily be folded as shown in FIG. 10 such that the information contained in section D would be displayed on the outside when presented to the customer since his or her name and that of the preparer would be readily visible. After checking in and getting a boarding pass, on the other hand, the jacket would likely be refolded by the traveler so that the boarding pass is visible on the outside while boarding the carrier since the hands are oftentimes full of carry-on luggage, a coat, a briefcase and some reading material. Thus, by leaving the jacket sticking out of the pocket or purse where the flight attendant can see the boarding pass he or she can easily remove same unassisted. Once on board, the traveler has immediately at his or her disposal a complete itinerary forming an integral part of the ticket jacket and appearing underneath the ticket pocket as seen most clearly in FIGS. 6, 8 and 9.

What is claimed is:

1. The multiple ply assembly form which comprises: a bottom ply, a top ply and at least one intermediate ply interposed between the top and bottom plies, said plies each having an upper edge, a lower edge and right and left side margins; means associated with two or more of the plies for transferring indicia imprinted on the top ply to the plies therebeneath; first serrations in all plies above the bottom ply extending horizontally thereof from side margin to side margin intermediate their upper and lower edges, said serrations providing means for separating said plies into upper and lower sections; adhesive means extending along one of the upper or lower edges and at least one side margin of the upper or lower section adjacent said one edge fastening said next above ply to the bottom ply therebeneath, said plies thus fastened together cooperating with one another to define a pocket open along the first serrated edge of said next above intermediate ply, and said section of said bottom ply remote from said one edge defining a flap foldable over said pocket containing such indicia as may have been imprinted upon said remote section of the top ply.

2. The multiple ply assembly form as set forth in claim 1 in which: the bottom ply includes a vertically-extending slit in the section thereof adjacent said one edge opening into the pocket.

3. The multiple ply assembly form as set forth in claim 1 in which: the form is of substantially uniform thickness from side margin to side margin and from upper edge to lower edge.

4. The multiple ply assembly form as set forth in claim 1 in which: detachable edge strips each containing a vertical series of equally-spaced sprocket-tooth-receiving holes for advancing the form stepwise through a computer printer border both side margins.

5. The multiple ply assembly form as set forth in claim 1 in which: the adhesive means extends along the upper edge and at least one side margin of the upper section to define a downwardly-opening pocket in the latter.

6. The multiple ply assembly form as set forth in claim 1 in which: the upper section of the top ply is preprinted.

7. The multiple ply assembly form as set forth in claim 1 in which: the underside of the bottom ply is preprinted.

8. The multiple ply assembly form as set forth in claim 1 in which: the indicia imprinted upon the multiple plies is confined to the lower sections thereof.

9. The multiple ply assembly form as set forth in claim 1 in which: the upper section of the top ply defines a tab accessible above the areas upon which the indicia is to be imprinted for removing the form from the printer.

10. The multiple ply assembly form as set forth in claim 1 in which: all plies are of substantially the same length, width and shape.

11. The multiple ply assembly form as set forth in claim 1 in which: the imprinted indicia is confined to the flap area and is normally readable with the pocket held in horizontal position.

12. The multiple ply assembly form as set forth in claim 1 in which: another series of serrations in the intermediate ply next above the bottom ply extend vertically between the side margins from the adhesively-attached upper or lower edge of the pocket to the first series of serrations thereby dividing said next above ply into right and left subsections one of which is detachable while the other remains a part of the pocket.

13. The multiple ply assembly form which comprises: a bottom ply, a top ply and at least two intermediate plies interposed between the top and bottom plies, said plies each having an upper edge, a lower edge and right and left side margins; means associated with two or more of the plies for transferring indicia imprinted on the top ply to the plies therebeneath; serrations in all plies above the bottom ply extending horizontally thereof from side margin to side margin intermediate their upper and lower edges, said serrations providing means for separating said plies into upper and lower sections; first adhesive means extending along one of the upper or lower edges and at least one side margin of the upper or lower section adjacent said one edge fastening said next above ply to the bottom ply therebeneath, said plies thus fastened together cooperating with one another to define a pocket open along the first serrated edge of said next above intermediate ply, and said section of said bottom ply remote from said one edge defining a flap foldable over said pocket containing such indicia as may have been imprinted upon said remote section of the top ply; second adhesive means fastening the top ply to the intermediate plies lying above said next above ply along one side margin to define a multiple ply subassembly; and a vertically extending series of serrations arranged in registered relation one above the other bordering the adhesively fastened side margins of the subassembly for separating the individual plies thereof from one another.

14. The multiple ply assembly form as set forth in claim 13 in which: the first adhesive means extends along the upper edge and at least one side margin of the upper section; and, in which the multiple ply subassembly overlies the pocket thus formed.

15. The multiple ply assembly form as set forth in claim 14 in which: the first adhesive means extends vertically along the right margin of the upper section and the second adhesive means extends vertically along the left margin thereof.

* * * * *